United States Patent [19]

Frentzel-Beyme

[11] Patent Number: 4,569,189

[45] Date of Patent: Feb. 11, 1986

[54] TWO-FOR-ONE YARN TWISTING SPINDLE ASSEMBLY HAVING NO BALLOON LIMITOR

[75] Inventor: Johannes Frentzel-Beyme, Monchen-gladbach, Fed. Rep. of Germany

[73] Assignee: Palitex Project-Company GmbH, Fed. Rep. of Germany

[21] Appl. No.: 655,944

[22] Filed: Sep. 28, 1984

[30] Foreign Application Priority Data

Oct. 8, 1983 [DE] Fed. Rep. of Germany ..... 3336714

[51] Int. Cl.[4] ..... D01H 7/86; D01H 1/10; D01H 15/00

[52] U.S. Cl. ..... 57/58.83; 57/58.49; 57/279; 57/354

[58] Field of Search ..... 57/279, 280, 58.49, 57/58.7, 58.83–58.86, 354–357

[56] References Cited

U.S. PATENT DOCUMENTS

| | | | |
|---|---|---|---|
| 2,641,896 | 6/1953 | Landolt | 57/58.83 |
| 2,871,648 | 2/1959 | Vibber | 57/58.83 X |
| 2,898,728 | 8/1959 | Fleuret | 57/58.83 |
| 3,295,306 | 1/1967 | Rehn | 57/58.83 |
| 3,494,119 | 2/1970 | Ratti | 57/58.83 X |
| 3,648,449 | 3/1972 | Greive | 57/354 X |
| 3,731,478 | 5/1973 | Franzen | 57/58.7 |
| 3,975,893 | 8/1976 | Franzen | 57/279 X |

FOREIGN PATENT DOCUMENTS

| | | |
|---|---|---|
| 504249 | 8/1930 | Fed. Rep. of Germany . |
| 1289470 | 2/1969 | Fed. Rep. of Germany . |
| 1045449 | 11/1953 | France . |
| 681562 | 10/1952 | United Kingdom . |

*Primary Examiner*—John Petrakes

*Attorney, Agent, or Firm*—Bell, Seltzer, Park & Gibson

[57] ABSTRACT

A two-for-one yarn twisting spindle assembly having no balloon limitor utilizes a ring member for receiving a generally horizontal air flow and yarn emerging from the spindle assembly during pneumatic threading and deflects the air flow and yarn generally vertically upwardly therefrom along the outside of the spindle assembly, avoiding interference with adjacent spindle assemblies without the necessity of a conventional balloon limitor, for subsequent threading operations.

6 Claims, 3 Drawing Figures

TWO-FOR-ONE YARN TWISTING SPINDLE ASSEMBLY HAVING NO BALLOON LIMITOR

FIELD OF THE INVENTION

This invention relates to a two-for-one yarn twisting spindle assembly having no balloon limitor and utilizing a ring member for receiving a generally horizontal air flow and yarn emerging from the spindle assembly during pneumatic threading and deflecting the air flow and yarn generally vertically upwardly therefrom along the outside of the spindle assembly, avoiding interference with adjacent spindle assemblies without the necessity of a conventional balloon limitor, for subsequent threading operations.

BACKGROUND OF THE INVENTION

Up to now, it was conventional to carry out pneumatic yarn threading operations through two-for-one yarn twisting spindle assemblies only when utilizing balloon limitors with such spindle assemblies. This was based on the fact that it was considered necessary to utilize a balloon limitor to form a gap between the spindle assembly and the balloon limitor for defining a path of travel of the air flow and yarn upwardly along the outside of the spindle assembly to prevent the flow of air and thus the yarn being pneumatically threaded from moving over into and interfering with the operation of adjacent two-for-one yarn twisting spindle assemblies. This arrangement is clearly illustrated in U.S. Pat. No. 3,975,893, issued Aug. 24, 1976, and assigned to the assignee of the present application.

As far as known by applicant, the only two-for-one yarn twisting spindle assemblies which have eliminated the use of balloon limitors were those spindle assemblies in which pneumatic threading of the yarn was not intended, such as described in GB-PS No. 681562.

Other prior art directed to compressed air operated threading devices may be seen in DE-PS No. 504249 dated 1929/30, and FR-PS No. 1045449, dated 1951/53. Pneumatic threading devices which are associated with two-for-one yarn twisting spindles are shown and described in DE-PS No. 12 89 470 of 1969 and U.S. Pat. No. 3,731,478, issued May 8, 1973.

Despite the general efforts for automation which have been intensified especially during the last decade, this prior art does not contain any suggestion which, in the sense of the present invention, could be applied to two-for-one yarn twisting spindle assembly having no balloon limitor. Obviously, the reason can only be seen in the fact that there was considerable prejudice among the experts to recognize or to face up with the problem underlying the present invention.

OBJECT AND SUMMARY OF THE INVENTION

Accordingly, it is the object of the present invention to provide a two-for-one yarn twisting spindle assembly having no balloon limitor and which includes means therein to cooperate with conventional pneumatic yarn threading mechanisms for ensuring that the yarn being pnuematically threaded is passed upwardly along the outside of the spindle assembly and avoids interference with adjacent spindle assemblies for subsequent threading operations.

By this invention, it has been found that the above object may be accomplished by providing a two-for-one yarn twisting spindle assembly having no balloon limitor and including a driven rotor mechanism defining therethrough a generally L-shaped yarn passageway providing an exit port out of the rotor mechanism at the end of the horizontal leg of the passageway, a stationary carrier mechanism for carrying a hollow supply package of yarn and defining therethrough an elongate yarn passageway joining with the rotor mechanism yarn passageway, and pneumatically-operated threading mechanisms cooperating with the yarn passageway for creating a flow of air through and out of the passageway for threading of yarn through the passageway so that the yarn and air flow emerge from the exit port in a generally horizontal path of travel. The spindle assembly further includes means for receiving the generally horizontal air flow and yarn emerging from the exit port and for deflecting the air flow and yarn generally vertically upwardly therefrom along the outside of the spindle assembly, avoiding interference with adjacent spindle assemblies without the necessity of a conventional balloon limitor, for subsequent threading operations.

The last mentioned means comprises a ring member having a height substantially less than the height of the spindle assembly and of a conventional balloon limitor and being positioned around the lower portion of the spindle assembly to define an annular gap between the rotor mechanism and the ring member. An inside surface is provided on the ring member having a first portion extending generally upwardly of the spindle assembly from just below the horizontal path of the air flow and yarn emerging from the exit port out of the rotor mechanism and widening concentrically and continuously in the upward direction, and a second portion of generally non-widening shape extending generally upwardly from the first portion.

Surprisingly, it has been determined by this invention that this configuration of an inner surface of a ring member will bundle and guide the air flow and yarn upwardly along the outside of the spindle assembly in such a manner that the yarn and air flow will not be deflected or interfere with adjacent two-for-one yarn twisting spindle assemblies.

BRIEF DESCRIPTION OF THE DRAWINGS

Some of the objects and advantages of this invention having been stated, other objects and advantages will appear as the detailed description of preferred embodiments of this invention is given in conjunction with the accompanying drawings, in which.

DETAILED DESCRIPTION OF PREFERRED EMBODIMENT OF THE INVENTION

Figure 1:
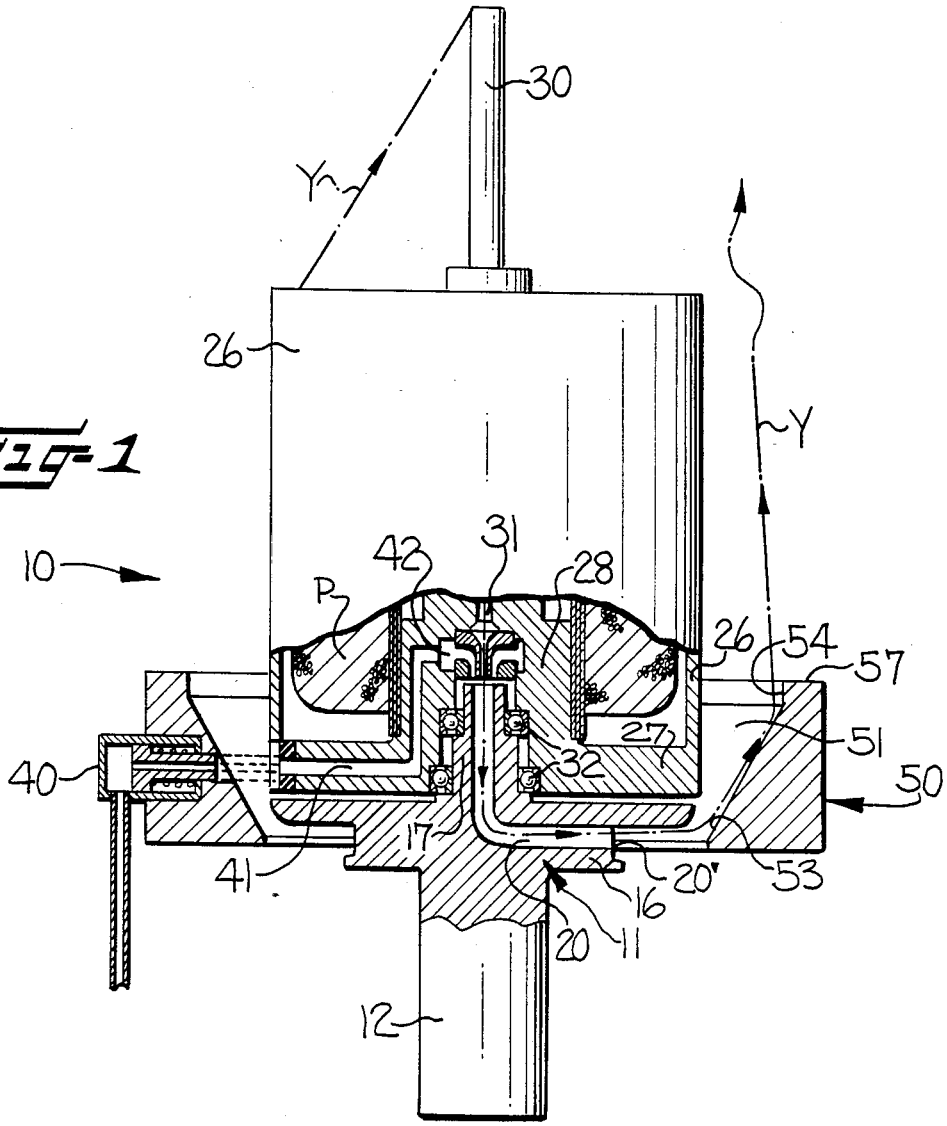
FIG. 1 is a partial side elevational view, partly in section, of the two-for-one yarn twisting spindle assembly constructed in accordance with this invention.

Referring now to the drawings, there is shown in FIG. 1 a portion of a spindle assembly, generally indicated at 10, in a two-for-one twister textile yarn processing machine. It is to be understood that a plurality of these spindle assemblies 10 are provided in side-by-side relationship in two full rows along the outside of such a machine. A full illustration and description of the entire two-for-one twister textile yarn processing machine is not given herein and is not believed to be necessary for an understanding of the present invention, the operation and complete structure of such a two-for-one twister yarn processing machine being well understood by those with ordinary skill in the art.

The spindle assembly 10 comprises a rotatably driven rotor mechanism, generally indicated at 11, which includes a whorl portion 12 suitably rotatably mounted on a portion of the twister frame (not shown) and rotated by a continuous, tangential, drive belt (not shown) in a manner well understood by those with ordinary skill in the art.

The rotor mechanism 11 further includes a horizontally extending yarn reserve disk 16 secured to the whorl 12 for rotation therewith and a generally vertically extending hollow axle device 17 which also rotates with the reserve disk 16. The reserve disk 16 and the hollow axle device 17 define therewithin a generally L-shaped yarn passageway 20 extending generally vertically through the hollow axle device 17 and a portion of the yarn reserve disk 16 and generally horizontally and radially out of the yarn reserve disk 16 at an exit port 20'.

The spindle assembly 10 further includes a stationary carrier mechanism, generally indicated at 25, for supporting and carrying a hollow package P of yarn Y and being rotatably mounted on the rotor mechanism 11 so that the rotor mechanism 11 may rotate relative thereto. The carrier mechanism 25 includes a basket device or protective pot 26 which surrounds the package P of yarn Y, a circular bottom portion 27 for supporting the hollow yarn supply package P and a hollow hub portion 28 extending into the hollow yarn supply package P for stabilizing the yarn supply package P. The hollow hub portion 28 extends to a hollow yarn entry tube 30 at the upper end thereof. The carrier mechanism 25 is rotatably mounted on the rotor mechanism 11 by means of bearings 32, so that the rotor mechanism 11 may rotate relative to the stationary carrier mechanism 25 which is held stationary by any suitable means such as magnets (not shown) contained therein and contained within another stationary portion of the spindle assembly 10.

The carrier mechanism 25, including the yarn entry tube 30, define a generally vertically extending yarn passageway 31 which is disposed in axial alignment with the yarn passageway 20 through the rotor mechanism 11 and joins with the yarn passageway 20 for providing continuous yarn passageways 31, 20 through the carrier mechanism 25 and the rotor mechanism 11.

With the above described spindle assembly 10, the yarn Y is withdrawn from the package P, passes through the yarn entry tube 30 and the yarn passageway 31 thereof. The yarn Y then passes through the generally L-shaped passageway 20 of the rotating rotor mechanism 11 and out of the reserve disk 16 at the exit port 20'. The yarn Y then passes upwardly along the outside of the basket device 26 and forms a rotating balloon of yarn as the rotor mechanism 11 is rotated. The yarn Y then passes to take-up winding mechanisms (not shown) for taking up the twisted yarn Y. As is well understood by those with ordinary skill in the art, a two-for-one twist is inserted in the yarn Y during the above noted path of travel.

The spindle assembly 10 also includes pneumatically-operated threading mechanisms, for automatically threading yarn Y through the spindle assembly 10 in the event of yarn breakage or during yarn start-up operations of the spindle assembly 10. The threading mechanisms may be of the type described in the aforementioned U.S. Pat. No. 3,975,893 and can utilize a compressed air supply nozzle device 40 which mates with a duct 41 through the bottom portion 27 of the carrier mechanism 25 and extends to an injector nozzle 42 in the stationary carrier mechanism 25 in alignment with yarn passageways 31, 20. As compressed air is supplied from the air supply nozzle 40 through the duct 41 to the injector nozzle 42, a positive air flow will be created through the yarn passageway 20 in the rotor mechanism 11 and a suction or negative air flow will be created through the yarn passageway 31 in the carrier mechanism 25. Therefore, if a yarn Y is placed at the entrance to the yarn inlet tube 30, it will be sucked into and through the yarn passageway 31 and will be blown through and out of the yarn passageway 20 for pneumatic threading of the yarn Y through the spindle assembly 10. The air flow and yarn Y will emerge from the exit port 20' in the rotor mechanism 11 in a generally horizontal path of travel.

For receiving the generally horizontal air flow and the yarn Y emerging from the exit port 20' during yarn threading operations and for deflecting the air flow and yarn Y generally vertically upwardly therefrom along the outside of the spindle assembly 10, avoiding interference with adjacent spindle assemblies without the necessity of a conventional balloon limitor, means are provided in accordance with this invention, generally as follows.

A ring member 50 having a height substantially less than the height of the spindle assembly 10 and of a conventional balloon limitor is positioned around the lower portion of the spindle assembly 10 to define an annular gap 51 between the rotor mechanism 11 and carrier mechanism 25, and ring member 50. An inside surface is provided on the ring member having a first portion 53 extending generally upwardly of the spindle assembly 10 from just below the horizontal path of the air flow and yarn Y emerging from the exit port 20' out of the rotor mechanism 11 and widening concentrically and continuously in the upward direction, preferably frusto-conically. The inside surface of the ring member 50 further includes a second portion 54 of generally non-widening shape extending generally upwardly from the first portion 53. This second portion 54 is preferably vertically-extending.

With this construction of ring member 50, the flow of air and yarn Y leaving the exit port 20' of the rotor mechanism 11 will be thrown against the first portion 53 of the inside surface of the ring member 50 and is first deflected obliquely upwardly and outwardly and then contacts the second portion 54 of the inside surface of the ring member 50 and is deflected in a generally vertical upward direction. The free end of the yarn Y can then be caught in the range of the upper end of the spindle assembly 10 and can be further threaded in the usual way through the take-up winding mechanisms (not shown) of the spindle assembly 10.

It has surprisingly turned out that a ring member 50 with the above described inside surface construction will bundle and guide the freely deflected air flow and yarn Y emerging from the exit port 20 of the rotor mechanism in such a way that the flow of air and yarn Y is directed substantially vertically upwardly and the yarn Y is carried without risk that the yarn Y will be blown to or interfere with the operation of adjacent spindle assemblies without the necessity of the use of a balloon limitor.

Figure 2:
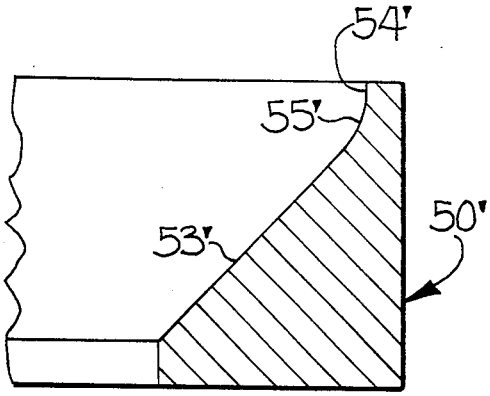
FIG. 2 is an enlarged view, partly in section, of a second embodiment of a construction of a ring member to be utilized in the spindle assembly of FIG. 1.

Referring now to FIG. 2 of the drawings, there is shown therein a second embodiment of a ring member, generally indicated at 50' and having a first portion 53' and a second portion 54' constructed generally in the configuration described above. However, the ring member 50' of this embodiment of FIG. 2 further includes a third portion 55' connecting the first and second portions 53', 54' and being of a rounded groove-like shape to provide for a uniform yarn transport along the inside surface of the ring member 50'.

Figure 3:
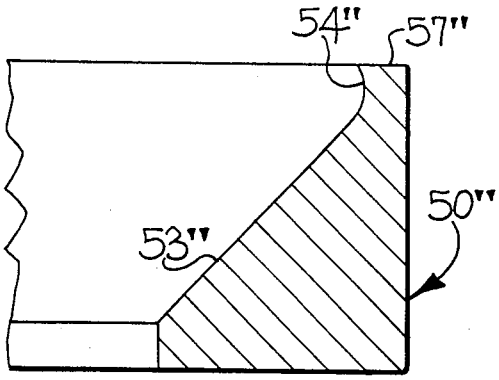
FIG. 3 is an enlarged view, partly in section, of a further embodiment of a ring member to be utilized in the spindle assembly of FIG. 1.

Referring now to FIG. 3, there is shown yet a third embodiment of a ring member 50'' which can be utilized in the spindle assembly 10 of this invention. This embodiment of a ring member 50' also includes first and second portions 53'', 54'' of an inside surface, wherein the first portion 53'' is constructed in accordance with the shape described above for the first portion 53 of the inside surface of the ring member 50 illustrated in FIG. 1. However, the second portion 54'' of the inside surface of the ring member 50'' of this embodiment is entirely of a rounded groove-like shape to provide for a specific transport of yarn to a predetermined position above the ring member 50''.

All of the embodiments of the ring members 50, 50', 50'', described above, may include a top generally flat surface 57, 57', 57'', respectively, which extends generally horizontally and radially outwardly from the second portions 54, 54' and 54'' of the inside surfaces of the ring members 50, 50', 50'', preferably at approximately 90°. By this arrangement, a rupturing edge for the upwardly directed flow of air is obtained so as to prevent, to a large extent, the spreading of the air flow and yarn Y in an outward direction.

The total height of the ring members 50, 50', 50'', is preferably between 40 and 60 mm. Heights smaller than 40 mm are possible if the ring member is not intended for receiving stationary holding magnets, discussed above. Heights greater than 60 mm are of no advantage because the yarn balloon, during normal operation of the spindle assembly 10, might then come into contact with the upper edge of the ring member which would be contrary to the principle of a spindle assembly having no balloon limitor.

In the above described drawings and the detailed description set forth, there has been described preferred embodiments of this invention and, although specific terms are employed, they are used in a generic and descriptive sense only and not for purposes of limitation.

I claim:

1. In a two-for-one yarn twisting spindle assembly having no balloon limitor and including a driven rotor mechanism defining therethrough a generally L-shaped yarn passageway providing an exit port out of said rotor mechanism at the end of the horizontal leg of said passageway, a stationary carrier mechanism for carrying a hollow supply package of yarn and defining therethrough an elongate yarn passageway joining with said rotor mechanism yarn passageway, and pneumatically-operated threading mechanisms cooperating with said yarn passageways for creating a flow of air through and out of said passageways for threading of yarn through said passageways so that the yarn and air flow emerge from said exit port in a generally horizontal path of travel; the combination therewith of means for receiving the generally horizontal air flow and yarn emerging from said exit port and for deflecting the air flow and yarn generally vertically upwardly therefrom along the outside of said spindle assembly, avoiding interference with adjacent spindle assemblies without the necessity of a conventional balloon limitor, for subsequent threading operations, said means comprising:

a ring member having a height substantially less than the height of said spindle assembly and of a conventional balloon limitor and being positioned around the lower portion of said spindle assembly to define an annular gap between said spindle assembly and said ring member;

an inside surface on said ring member extending around the lower portion of said spindle assembly and having a first portion extending generally upwardly of said spindle assembly from just below the horizontal path of the air flow and yarn emerging from said exit port out of said rotor mechanism and widening concentrically and continuously in the upward direction, and a second portion of generally non-widening shape extending generally upwardly from said first portion.

2. In a two-for-one yarn twisting spindle assembly, as set forth in claim 1, in which said second portion of said inside surface of said ring member is vertically-extending.

3. In a two-for-one yarn twisting spindle assembly, as set forth in claim 1, in which said inside surface of said ring member further includes a third portion connecting said first and second portions and being of a rounded groove-like shape.

4. In a two-for-one yarn twisting spindle assembly, as set forth in claim 1, in which said second portion of said inside surface of said ring member is of a rounded groove-like shape.

5. In a two-for-one yarn twisting spindle assembly, as set forth in claims 1, 2, 3 or 4, in which said ring member further includes a top generally flat surface extending generally horizontally and radially outwardly from said second portion of said inside surface.

6. In a two-for-one yarn twisting spindle assembly, as set forth in claims 1, 2, 3 or 4, in which said ring member has a height of generally between 40 and 60 mm.

* * * * *

UNITED STATES PATENT AND TRADEMARK OFFICE

CERTIFICATE OF CORRECTION

PATENT NO. : 4,569,189

DATED : February 11, 1986

INVENTOR(S) : Johannes Frentzel-Beyme

It is certified that error appears in the above-identified patent and that said Letters Patent is hereby corrected as shown below:

Column 5, line 16 "50'" should be -- 50" --.

Signed and Sealed this

*Third* Day of *June 1986*

[SEAL]

*Attest:*

DONALD J. QUIGG

*Attesting Officer*

*Commissioner of Patents and Trademarks*